US005779039A

United States Patent [19]

Ambrus

[11] Patent Number: 5,779,039

[45] Date of Patent: Jul. 14, 1998

[54] PROTECTIVE DEVICE

[76] Inventor: Sándor Z. Ambrus, 4 Highview Crescent, Suite 3, Toronto, Ontario, Canada, M6H 2Y2

[21] Appl. No.: 802,957

[22] Filed: Feb. 21, 1997

[51] Int. Cl.[6] ..... B65D 85/57; B65D 85/575

[52] U.S. Cl. ..... 206/308.2; 206/387.11; 206/1.5

[58] Field of Search ..... 206/308.2, 308.3, 206/308.1, 1.5, 387.11

[56] References Cited

U.S. PATENT DOCUMENTS

| | | | |
|---|---|---|---|
| D. 313,412 | 1/1991 | Holmgren . | |
| 4,516,999 | 5/1985 | Gollwitzer | 206/1.5 |
| 4,819,797 | 4/1989 | Holmgren . | |
| 4,865,190 | 9/1989 | Gregerson et al. | 206/308.2 |
| 5,031,756 | 7/1991 | Buzzard et al. | 206/308.2 |
| 5,123,526 | 6/1992 | Gelardi et al. | 206/308.2 |
| 5,211,283 | 5/1993 | Weisburn et al. | 206/308.2 |
| 5,215,188 | 6/1993 | Wittman | 206/308.2 |
| 5,297,672 | 3/1994 | MacTavish | 206/308.2 |
| 5,524,752 | 6/1996 | Mazzucchelli | 206/308.2 |
| 5,636,535 | 6/1997 | Shimada | 206/1.5 |

FOREIGN PATENT DOCUMENTS 0 308 810 A2 9/1988 European Pat. Off. .

WO 92/18734 10/1992 WIPO .

*Primary Examiner*—Paul T. Sewell
*Assistant Examiner*—Anthony Stashick
*Attorney, Agent, or Firm*—Riches, McKenzie & Herbert

[57] ABSTRACT

The invention relates to a means to prevent goods from being misappropriated, suitable to accommodate storage units especially of prismatic shape e.g. cases of sound-, picture- and data carriers, the said means having an internal space adapted to the shape of the storage unit and a casing that includes covering plates surrounding the internal space at least partly, being the casing provided with a free opening to introduce the storage unit into the internal space; furthermore, the casing is provided with a protective hollow surrounded by a box located in the vicinity of the free opening; the said protective hollow is provided with a locking mechanism, being the said locking mechanism provided with a carrier element movable within the protective hollow as well as a clamping device associated with the carrier element covering the free opening of the casing at least partly and being able to be fixed in this position; the carrier element is provided with one or more grasping profiles located within the protective hollow; the grasping profiles are in connection to the linking elements each located within the box, while the casing is provided with release openings enabling the locking mechanism to be released.

12 Claims, 2 Drawing Sheets

PROTECTIVE DEVICE

Figure 1:
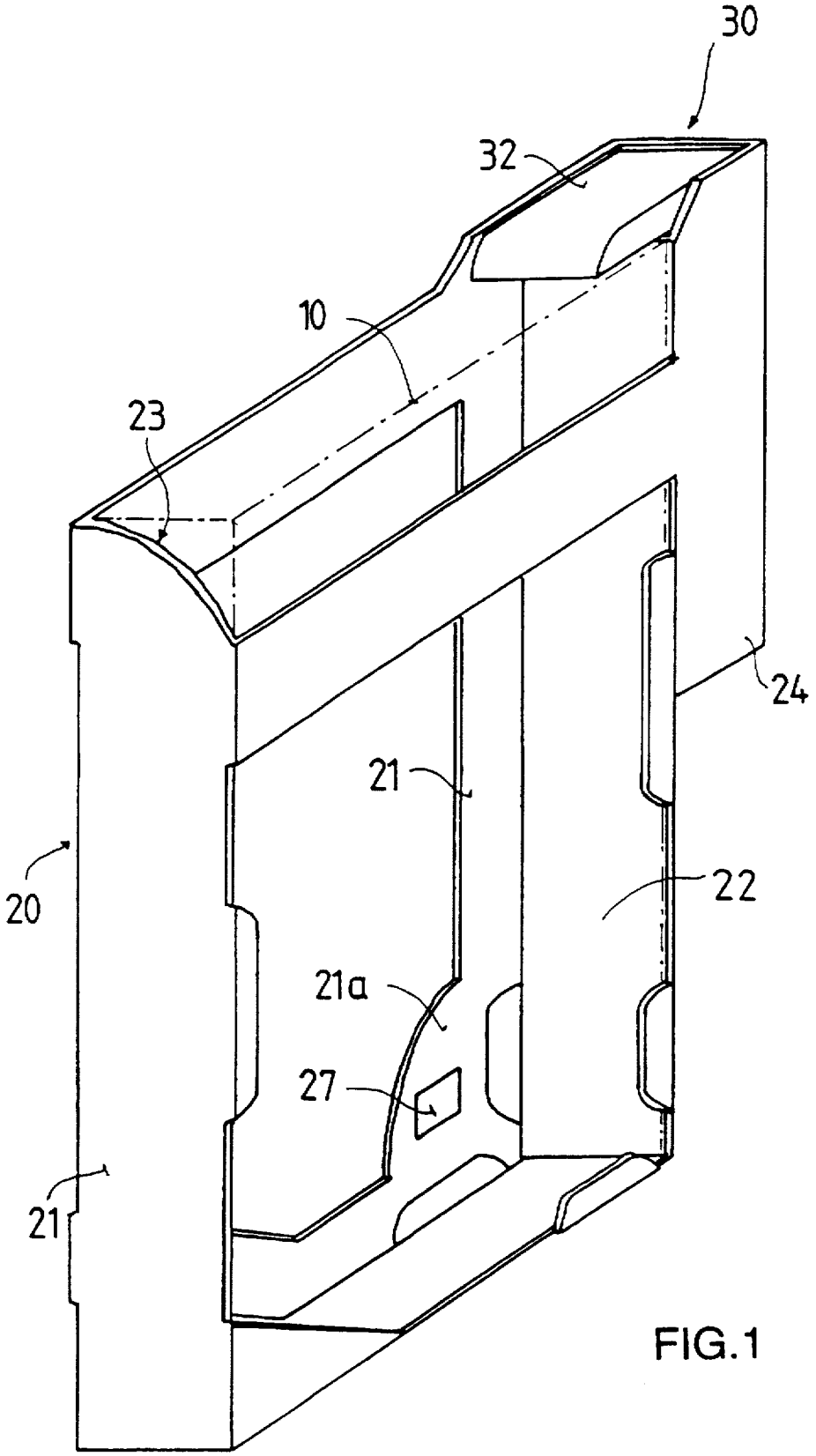

The invention relates to a means to prevent goods from being misappropriated, suitable to accommodate storage units especially of prismatic shape e.g. cases of sound-, picture- and data carriers, the said means having an internal space adapted to the shape of the storage unit and a casing that includes covering plates surrounding the internal space at least partly, being the casing provided with a free opening to introduce the storage unit into the internal space; furthermore, the casing is provided with a protective hollow surrounded by a box located in the vicinity of the free opening; the said protective hollow is provided with a locking mechanism, being the said locking mechanism provided with a carrier element movable within the protective hollow as well as a clamping device associated with the carrier element covering the free opening of the casing at least partly and being able to be fixed in this position; the carrier element is provided with one or more grasping profiles located within the protective hollow; the grasping profiles are in connection to the linking elements each located within the box, while the casing and/or the box is/are provided with release openings enabling the locking mechanism to be released.

In recent times, means to prevent goods from being misappropriated are more and more widely used in business units. One of the simplest way is to use e.g. a ferromagnetic thread embedded in the ID labels of goods or a simple electric circuit with specific parameters designed as a label, located usually on the outer surface of goods or attached to the packaging.

Its disadvantage is, however, that it provides only poor protection; in fact, goods with the protective label removed can be taken out of the shop without being detected by the supervisory protective system; thus, failing the goods to protect from being stolen.

In order to prevent various picture-, sound- and data carriers as well as other marketable goods, safety boxes are also used in addition to the protective means. Their essence is, that the goods provided with protective label will be placed in a carton-like casing made of some at least semi-transparent material, provided with lock at its opening; thus, the protective label placed within the box is unable to be reached by unauthorized persons.

Solution suitable to be used to protect video cassettes, CD discs and similar goods is described among others in the patent specification registered under No. EP 589.551. In the embodiment described, the cover and the bottom of casing fastening the cassette are secured together by means of a sliding bolt guided by flutes machined in both the bottom and the cover. The sliding bolt is secured in its closed position by snapping the elastic tabs arranged along the path of movement of the bolt into the locking indents.

For the opening of casing, the tabs shall be released from the indents by inserting an appropriate tool into the opening on the bolt and pushing the bolt out of the flutes while maintaining the tabs in their released position.

This design has the disadvantage that the casing can be easily opened by means of a simple device. Therefore, the locking device provides protection only to a limited extent; thus failing to prevent the cassette contained in the casing from being stolen.

A solution developed for protection of CD discs is described in the patent specification No. EP 223.760, the essence of which is that, by means of a locking element that can be pushed in the recess of the CD casing, a non-displaceable connection between the recess formed on the rim of casing accommodating the CD disc and the locking device formed in the protective means provided with an opening will be established, thus being able to prevent the product from being misappropriated.

However, the disadvantage of the solution is that, due to its structural design, it is suitable to protect only casings that meet special requirements. In addition, its reliability also falls short of expectations.

A further disadvantage is, that the locking mechanism is easy to understand which facilitates the casing to be opened.

The patent specification No. EP 620.888 describes a locking device covered from outside in which the free opening to access to the inner space of casing is narrowed down by a clamping element turned into the opening, and the clamping element is fastened in its closed position by means of a hooked locking element that can be rotated. The locking device is provided with a spring plate with one end embedded in the wall and the other end pressed against the locking element. During operation, the spring follows the mantle of the rotating locking element and snaps behind the shoulder on the mantle in the closed position of the locking element, thus preventing the locking element from turning back and the casing from being opened.

For the opening, a magnet approached from outside to the spring plate causes the spring plate to bend over the shoulder, thus enabling the locking element to be turned back from its locking position.

The solution has the disadvantage that, by using a magnet of proper field intensity, anybody is able to open the casing, thus offering very poor protection to the goods.

It is also disadvantageous that, due to its complicated mechanism, the complex device is susceptible to mechanical damages which, in turn, further reduces the possibility of efficient protection.

Furthermore, the solutions known so far have the general disadvantage that the closing elements hooked up to the perimeter of the casing to be protected are surrounded and embedded, respectively, only to a reduced extent; thus, they can be wrenched off or broken down from the other parts of closing device.

A further common disadvantage of the lock-up types is that the envelope accommodating the locking device can be removed from the protective means without any significant effort which, again, fails to prevent the goods from being misappropriated.

The solution according to the invention is aimed at eliminating the deficiencies of the known anti-theft protective means and at developing a version which enables the locking device serving for preventing the goods from being removed to establish a connection between the casing of the protective means and the hooking element that closes the free opening, that is undestroyable and unable to be opened by using simple tools.

A further objective is, that the hooking element ensuring the actual protection of the goods takes a position protected as far as possible in its closed state and, due to its structural design, will be able to withstand even large destructive or tensile forces.

The development of the embodiment according to the invention was based on the recognition that, by connecting the carrier element and the hooking element of the closing device in a special manner other than that known so far to enable them to perform linear motions preferably perpendicular to each other during their operation, as well as by designing the casing accommodating the locking device in a special geometric form, the hooking element can be placed in its closed position which meets the objective set.

According to the objective set, the means to prevent goods from being misappropriated, suitable to accommodate storage units especially of prismatic shape e.g. cases of sound-, picture- and data carriers-, the said means having an internal space adapted to the shape of the storage unit and a casing that includes covering plates surrounding the internal space at least partly, being the casing provided with a free opening to introduce the storage unit into the internal space; furthermore, the casing is provided with a protective hollow surrounded by a box located in the vicinity of the free opening; the said protective hollow is provided with a locking mechanism, being the said locking mechanism provided with a carrier element movable within the protective hollow as well as a clamping device associated with the carrier element covering the free opening of the casing at least partly and being able to be fixed in this position; the carrier element is provided with one or more grasping profiles located within the protective hollow; the grasping profiles are in connection to the linking elements each located within the box, while the casing and/or the box is/are provided with release openings enabling the locking mechanism to be released—is designed in a manner that a primary guide device with its axis forming an angle of 60° to 120°, preferably 90° with the axis of displacement of the carrier element is arranged on the carrier element at its outer end opposite to the grasping profiles; the clamping device is provided with a nose-piece protruding towards the free opening of the casing as well as a secondary guide device of shape and size adapted to the primary guide device of the carrier element and cooperating therewith, that allows the clamping device to slide along the primary guide device of the carrier element; in the closed state of the locking device, the clamping device is inserted into the protective hollow of the box and at least part of the rear wall and/or side wall of the clamping device is in fixed connection with the box preventing any displacement; while in the open position of the locking device, the clamping device is pulled out of the protective hollow of the box to allow any displacement.

A further criterion of the protective means according to the invention may be that at least two fixing extensions capable of suffering elastic deformation are arranged on the carrier element at its inner end inserted into the protective hollow, while the grasping profiles being arranged on the fixing extensions.

In respect of the embodiment, it is advantageous that the clamping device is provided with a linking segment. The box and the carrier element enclose a linking space. The linking segment of the clamping device protrudes into the linking space.

In another version of the protective means, the primary guide device of the carrier element consists in a straight prism, while the secondary guide device of the clamping device is used as a guide hole.

In a further exemplary embodiment, the locking mechanism is completed with a safety piece connected to the carrier element. In the box enclosing the protective hollow, a clamping hole accommodating at least part of the head of the safety piece is arranged.

In respect of the protective means, it may be favourable that at least one of the covering plates of casing is provided with a carrier zone suitable to accommodate a signalling device serving for protection of goods.

The most important advantage of the invention is that, due to the special path of movement of the clamping device and the original design of the locking mechanism, the clamping device can be fixed in the box connected to the casing of the protective means in a manner that, by supporting the clamping device, its strength and loadability in its closed state will be significantly increased, thus, it is essentially be prevented from being forced open or unlocked.

A further advantage is that, due to its special design, the locking mechanism can also be provided with a safety piece, thus farther improving the safety of the protective means against sabotage.

It shall also be considered to be favourable that, due to its structural design, the locking mechanism is essentially unable to be unlocked but by means of the key serving for this specific purpose.

It shall also be considered to be a further advantage that the component part of the device are able to be produced by using traditional technology, easy to assemble and, essentially, do not require any maintenance.

It is also an important advantage that the new design enables the box of the locking mechanism as well as the casing to be made of a single piece which, again, increases the resistance to any sabotage.

In the following, the protective means according to the invention will be described by means of exemplary embodiments, based on drawings as follows.

Figure 2:
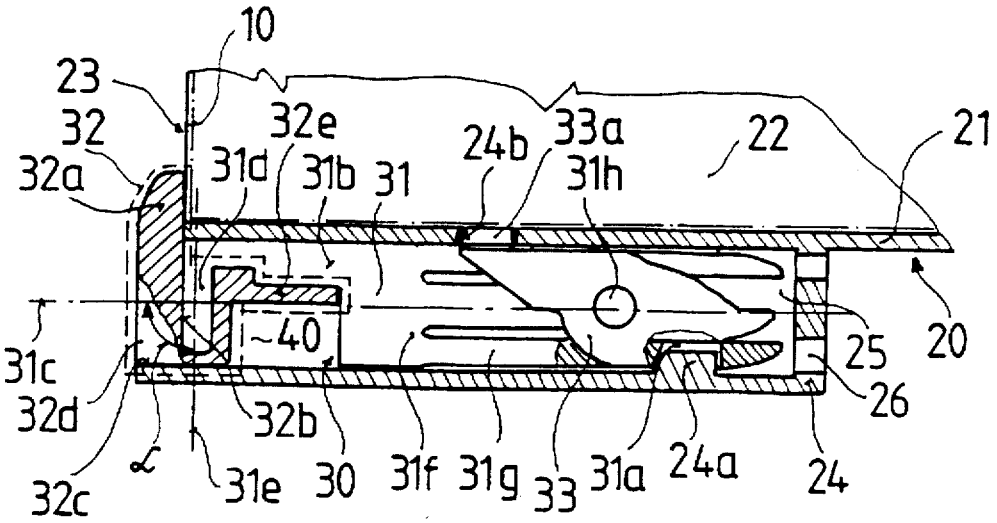
Figure 3:
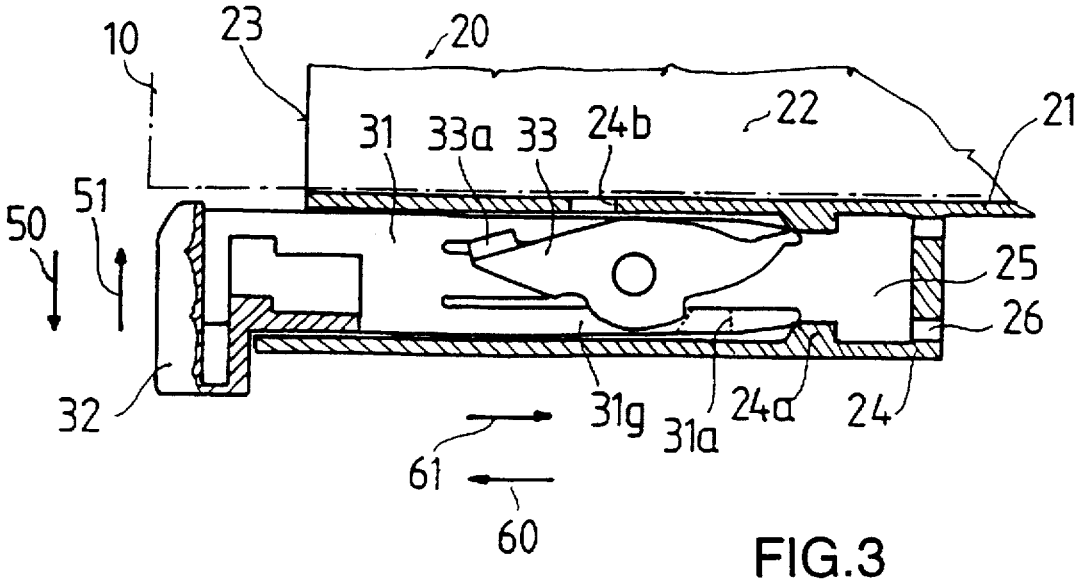

FIG. 1 shows a view of an exemplary version of the protective means according to the invention FIG. 2 shows the locking mechanism in its locked state FIG. 3 shows the locking mechanism in its unlocked state.

In FIG. 1, an exemplary version of the protective means according to the invention, suitable to accommodate CD discs in this case, is represented. The 20 casing provided with the 21 covering plates and the 10 storage unit—represented by dotted line here—accommodated in its 22 internal space are well shown.

FIG. 1 also shows that the 21 covering plates forming the 20 casing do not enclose the 10 storage unit completely; instead, the 10 storage unit is surrounded only to the extent necessary for safety, still ensuring the visibility to the customers. The 20 casing is provided with the 23 free opening adapted to the shape of goods to be placed in its 22 internal space, which allows the 10 storage unit to be inserted through the 23 free opening in the 22 internal space of the 20 casing.

In this exemplary embodiment, a 24 box forming an integral part together with the 20 casing and made of the same material is arranged along the 23 free opening of the 20 casing, which serves for accommodating and protecting the 30 locking mechanism. It shall be noted here that, due to the simplicity of production, it is preferable to make the 20 casing of some plastic material e.g. die-cast polycarbonate.

FIG. 1 shows only the 32 clamping device of the 30 locking mechanism, protruding into the 23 free opening of the 20 casing in its locked state, thus preventing the 10 storage unit from be removed from the 22 internal space of 20 casing.

The 21*a* carrier zone on one of the 21 covering plates also forms part of the 20 casing, which allows the 27 signalling device enclosed between the 21 covering plate and 10 storage unit to be formly fixed within the 22 internal space of the 20 casing. Preferably, the 27 signalling device consists in some signal transmitter known in itself which, as part of the safety system, generates an alarm signal in the system if an attempt is made to take the 10 storage unit together with the 20 casing away from the shop.

FIG. 2 shows the 30 locking mechanism of the protective means according to the invention, in its locked state. It is well shown that the 30 locking mechanism is composed of the 31 carrier element, the 32 clamping device and—in this version—the 33 safety piece, being said 30 locking mechanism arranged within the 25 protective hollow of 24 box in order to allow its displacement.

The 31 carrier element is provided with the 21*d* primary guide device arranged at its 31*b* outer end, the 31*g* fixing extensions—made of some elastic material and arranged as a pair of pincers—designed as extensions to the 31*f* inner end of the 31 carrier element, as well as the 31*h* connection stub serving as a bearing for the 33 safety piece.

FIG. 2 shows that the 31*d* primary guide device consists in a straight prism with its 31*e* axis forming an angle α—of 90° in this exemplary embodiment—with the 31*c* longitudinal axis of the 31 carrier element. It is also shown that the 31*g* fixing extension is provided with 31*a* grasping profiles that, in this version, are designed as indents machined in the 31*g* fixing extension, being their shape adapted to the 24*a* linking elements—of thorn shape here—protruding into the 25 protective hollow of the 24 box.

The link between the 32 clamping device and the 31 carrier element is ensured by the 32*b* secondary guide device formed in the 32 clamping device, which, in this embodiment, consists in a guide hole accommodating the 31*d* primary guide device of straight prismatic envelope, associated with the 31 carrier element.

The 32*d* primary guide device of the 31 carrier element and the 32*b* secondary guide device of the 32 clamping device shall be selected and fitted together in a manner to enable the 32 clamping device to perform linear motion in the direction of the 31*e* axis.

It is also well shown in FIG. 2 that, in the locked state of 30 locking mechanism, the 32*a* nose-piece of the 32 clamping device protrudes into the 23 free opening of the 20 casing and covers it in part. At the same time, both the 32*c* rear wall and the 32*d* side walls of 32 clamping device will be completely immersed in the 25 protective hollow of 24 box in the 20 casing, thus making the 32 clamping device essentially inaccessible from this direction.

It shall be emphasized here that the 32 clamping device thus embedded—in a way that shows fundamental differences as compared to the solutions known so far—is capable of withstanding more efficiently any wrenching forces even from the direction of 32*a* nose-piece of the 32 clamping device; in fact, both the 32*c* rear wall supported by the 25 protective hollow as well as the 31*d* primary guide device and the 32*b* secondary guide device fitted together withstand such tensile force. Taking any possible load into consideration, it is also preferable to make this component part of high-tensile plastic material; of course, other material e.g. metal can also be used.

It shall also be noted that, of course, the 31*d* primary guide device and the 32*b* secondary guide device as well as their connection may be designed in a manner different from that described here. The essence is, that the cooperation between these two elements shall allow the guided linear motion already mentioned and to be detailed below.

The 31 carrier element and the 32 clamping device will be held together in their unlocked position by the 32*e* linking segment extended from the 32 clamping device, which protrudes into the 40 linking space formed in the vicinity of the 24 box and the 31*b* outer end of the 31 carrier element, thus preventing the 32 clamping device—shown well in FIG. 3—from sliding out of the 31 carrier element in the unlocked state of the 30 locking mechanism.

A further element to hold the 30 locking mechanism in its end position is the 33 safety piece, the 33*a* head of which is turned in the 24*b* clamping hole recessed in the 24 box of the 20 casing, thus further improving the safety of the 30 locking mechanism in its locked state against prying.

FIG. 3 shows the 30 locking mechanism in its unlocked state. In this position, the 31 carrier element slid in the direction of 60 arrow takes its other end position; while the 32 clamping device slid backwards according to the 50 arrow makes the 23 free opening of the 20 casing permeable, thus allowing the 10 storage unit to be removed from the 22 internal space of the 20 casing.

In the unlocked position of the 30 locking mechanism as shown, the 31*a* grasping profiles on the 31*g* fixing extensions of the 31 carrier element do not engage into the 24*a* linking elements protruding into the 25 protective hollow of the 24 box in the 20 casing, with the 33*a* head of the 33 safety piece also remaining out of the 24*b* clamping hole of the 24 box.

The displacement of the 31*g* fixing extensions of the 31 carrier element by means of elastic deformation as well as turning of the 33 safety piece can be performed by using a special purpose unlocking tool—not shown in the Figure—, the operating profiles of which will be inserted through the 26 unlocking holes into the 25 protective hollow of the 24 box and cause the 31 carrier element and the 33 safety piece appropriately displaced for unlocking.

During the operation of the protective means according to the invention, with the 30 locking mechanism in its unlocked position, the 10 storage unit can be freely inserted through the 23 free opening on the 20 casing into the 22 internal space of 20 casing. Then, the 32 clamping device of the 30 locking mechanism shall be pushed in the direction of 51 arrow towards the 23 free opening on the 20 casing until it stops, so as to allow the 32*c* rear wall of the 32 clamping device to reach the 25 protective hollow. As a next step, by pushing the 32 clamping device together with the 31 carrier element according to the 61 arrow into the 25 protective hollow, the 32 clamping device shall be recessed into the 24 box in a manner that its 32*c* rear wall and 32*d* side walls will be located—completely in this version—in the 25 protective hollow.

By pushing the 30 locking mechanism consisting of the 31 carrier element, 32 clamping device and the 33 safety piece backwards until it stops, the process that takes place within the 25 protective hollow will be as follows. During the displacement, the flexible 31*g* fixing extensions while sliding on the 24*a* linking elements suffer elastic deformation and approach each other until the hollow 31*a* grasping profiles formed on the 31*g* fixing extensions reach the 24*a* linking elements; at this point, the 31*a* grasping profiles of the 31*g* fixing extensions slide over the 24*a* linking elements and will be firmly connected together. Meanwhile, the 33*a* head of the 33 safety piece—forced by a spring not represented in the Figure—turns into the 24*b* clamping hole formed in the 24 box and establishes a firm connection by means of interlocking as above.

When unlocking the 30 locking mechanism—as mentioned above—, by means of an appropriate tool the 31*g* fixing extensions of the 31 carrier element shall be bent and the 33 safety piece shall be turned away around the 31*h* connection stub. Then, the 31*a* grasping profiles of the 31 carrier element will be disengaged from the 24*a* linking elements of the 24 box and the 33*a* head of the 33 safety piece will be turned out of the 24*b* clamping hole of the 24 box. In this position of the 30 locking mechanism, the 31 carrier element can be pushed out of the 25 protective hollow in the 24 box in the direction of 61 arrow. At the moment the 32 clamping device leaves the 25 protective hollow, the 32*a* nose-piece moves in the direction of 50 arrow, thus making the 23 free opening of the 20 casing unobstructed, thereby allowing the 10 storage unit to be removed from the 22 internal space of he 20 casing.

The protective means according to the invention is well suitable to protect any products packaged in cases, especially, those provided with storage unit of parallelepiped shape, against misappropriation.

List of references

10 storage unit
20 casing
21 covering plates
22 internal space
23 free opening
24 box
24*a* linking element
24*b* clamping hole
25 protective hollow
26 unlocking hole
27 signalling device
30 locking mechanism
31 carrier element
31*a* grasping profiles
31*b* outer end
31*c* axis
31*d* primary guide device
31*e* axis
31*f* inner end
31*g* fixing extension
31*h* connection stub
32 clamping device
32*a* nose-piece
32*b* secondary guide device
32*c* rear wall side wall
32*d* side wall
32*e* linking segment
33 safety piece
33*a* head
40 linking space
50 arrow
51 arrow
60 arrow
61 arrow
α angle

I claim:

1. Protective means to prevent goods from being misappropriated, suitable to accommodate storage units especially of prismatic shape, said means having an internal space adapted to the shape of the storage unit and a casing that includes covering plates surrounding the internal space casing provided with a free opening to introduce the storage unit into the internal space; furthermore, the casing is provided with a protective hollow surrounded by a box located in the vicinity of the free opening; the said protective hollow is provided with a locking mechanism, being the said locking mechanism provided with a carrier element movable within the protective hollow as well as a clamping device associated with the carrier element covering the free opening of the casing at least partly and being able to be fixed in this position; the carrier element is provided with one or more grasping profiles located within the protective hollow; the grasping profiles are in connection to linking elements each located within the box, while the casing is provided with release openings enabling the locking mechanism to be unlocked, characterized in that primary guide device (31*d*) with its axis (31*e*) forming an angle of about 60° to 120°, with the axis (31*c*) of displacement of the carrier element (31) arranged on the carrier element (31) at its outer end (31*b*) opposite to the grasping profiles (31*a*); the clamping device (31) is provided with a nose-piece (32*a*) protruding towards the free opening (23) of the casing (20) as well as a secondary guide device (32*b*) of shape and size adapted to the primary guide device (31*d*) of the carrier element (31) and cooperating therewith, that allows the clamping device (32) to slide along the primary guide device (31*d*) of the carrier element (31); in the closed state of the locking device (30), the clamping device (32) is inserted into the protective hollow (25) of the box (24) and at least part of the rear wall or side wall (32*d*) of the clamping device (32) is in fixed connection with the box (24) to prevent any displacement; while in the open position of the locking device (30), the clamping device (32) is pulled out of the protective hollow (25) of the box (24) to allow any displacement.

2. Protective means as in claim 1 characterized in that at least two fixing extensions (31*g*) capable of suffering elastic deformation are arranged on the carrier element (31) at its inner end (31*f*) and inserted into the protective hollow (25), while the grasping profiles (31*a*) are arranged on the fixing extensions (31*g*).

3. Protective means as in claim 2 characterized in that the clamping device (32) comprises a linking segment (32*e*).

4. Protective means as in claim 3 characterized in that the box (24) and the carrier element (31) enclose a linking space (40).

5. Protective means as in claim 4 characterized in that the linking segment (32*e*) of the clamping device (32) protrudes into the linking space (40).

6. Protective means as in claim 5 characterized in that the primary guide device (31*d*) of the carrier element (31) consists of a straight prism.

7. Protective means as in claim 6 characterized in that the secondary guide device (32*b*) of the clamping device (32) is designed as a guide hole.

8. Protective means as in claim 7 characterized in that the locking mechanism (30) comprises a safety piece (33) connected to the carrier element (31).

9. Protective means as in claim 8 characterized in that a clamping hole (24*b*) accommodating at least part of head (33*a*) of the safety piece (33) is arranged in the box (24) enclosing the protective hollow (25).

10. Protective means as in claim 9 characterized in that at least one of the covering plates (21) of casing (20) is provided with a carrier zone (21*a*) suitable to accommodate a signalling device (27) serving for protection of goods.

11. Protective means as in claim 10 characterized in that the axis (31*e*) of the primary guide device (31*d*) forming an angle with the axis (31*c*) of displacement of the carrier element (31) of about 90°.

12. Protective means as in claim 10 characterized in that the storage units comprises cases for sound carriers, cases for picture carriers or cases for data carriers.

* * * * *